US005918526A

United States Patent [19]

Jauhola

[11] Patent Number: 5,918,526

[45] Date of Patent: Jul. 6, 1999

[54] METHOD IN A PNEUMATIC OSCILLATING DEVICE TO OBSERVE AN OBSTACLE AND TO CONTINUE OSCILLATING AND CORRESPONDING OSCILLATING DEVICE

[76] Inventor: Lauri Jauhola, Luotipussi 16, Fin-40630, Jyväskylä , Finland

[21] Appl. No.: 08/973,277

[22] PCT Filed: Mar. 27, 1996

[86] PCT No.: PCT/FI96/00299

§ 371 Date: Nov. 28, 1997

§ 102(e) Date: Nov. 28, 1997

[87] PCT Pub. No.: WO96/38673

PCT Pub. Date: Dec. 5, 1996

[30] Foreign Application Priority Data

May 31, 1995 [FI] Finland ..... 952637
Oct. 23, 1995 [FI] Finland ..... 955033

[51] Int. Cl.[6] ..... F01L 15/14

[52] U.S. Cl. ..... 91/246; 91/336; 91/350

[58] Field of Search ..... 91/218, 246, 335, 91/336, 350, 356, 392, 405

[56] References Cited

U.S. PATENT DOCUMENTS 3,358,563 12/1967 Williams ..... 91/246
3,724,331 4/1973 Kobayashi ..... 91/407
4,002,103 1/1977 Martin ..... 91/350 X
4,700,611 10/1987 Kaneko ..... 91/405
5,490,441 2/1996 Hallstrom et al. ..... 91/335 X

*Primary Examiner*—Hoang Nguyen
*Attorney, Agent, or Firm*—Jones & Askew

[57] ABSTRACT

The object of the invention is a method in a pneumatic oscillating device for observing an obstacle within the length of the work stroke and continuing the oscillating movement after this. The oscillating device includes a double-acting operating cylinder (1), a principal operating valve (6) controlling this, and a reversing valve (4), by which the principal operating valve (6) is controlled. A resistance to the flow on whichever return line (1.31, 1.41) of the operating cylinder (1) is in use, is arranged in order to maintain the return side pressure of the operating cylinder (1) at a level that is clearly higher than the ambient pressure during a work stroke in a normal situation, and sensing the pressure of the return side and, if it drops below a set limit, which is indicated by the movement of the pressure slowing or stopping completely, giving a command to the reversing valve (4) to change direction on the basis of this.

8 Claims, 2 Drawing Sheets

METHOD IN A PNEUMATIC OSCILLATING DEVICE TO OBSERVE AN OBSTACLE AND TO CONTINUE OSCILLATING AND CORRESPONDING OSCILLATING DEVICE

The object of the invention is a method in a pneumatic oscillating device for observing an obstacle within the length of the work stroke and continuing to oscillate, which oscillating device includes a double-acting cylinder, a principal control valve operating it, and a reversing valve, by means of which the principal operating valve is controlled. The invention also concerns a method for realizing the oscillating device.

Pneumatic oscillating devices are mainly used in the paper and pulp industry for moving doctor blades and jet pipes. The operating conditions are extremely difficult in terms of moisture and temperature. However, it is very important that the device is highly reliable.

Machines are known that move backwards and forwards, in which the back and forwards movement is usually accomplished by means of a pressure sensor. When the movement of the operating cylinder ends, the pressure increases on the compression side, which can be sensed and from which a signal can be transmitted to a reversing member. Another alternative is to use the pressure difference over the cylinder to indicate jamming. A third alternative is to use limit switches. A fourth alternative is based on a time limit providing a work stroke, which when exceeded gives a positive command for the return stroke. Most of the solutions are unreliable in operation and are liable to faults. None of the known solutions referred to above are able to deal in an acceptable way with a situation, in which the operating cylinder stops at a random obstacle in the middle of its work stroke. The operating cylinder is then quite simply jammed either completely in place or, even with a time limit, for a long time, which may be very detrimental to the device being operated.

The intention of this invention is to create a new type of method and oscillating device, by means of which the defects in the known devices can be corrected. According to the invention, data on the slowing or total stopping of the movement of the piston is obtained from the return side pressure, on the line of which a throttle is arranged to increase the normal pressure above the ambient pressure. By means of a simple pressure limit switch it is possible to send a signal from this pressure drop, most advantageously pneumatically, to a reversing valve, which then reverses the direction of the operating cylinder. If the obstacle is permanent, the same thing is repeated on the following stroke, when an oscillating device according to the invention then continues movement to the extent that it is possible without damaging construcions. An alarm signal is also sent to the reversing valve from this signal of the pressure limit switch.

Other advantages and embodiments of the invention are described later in connection with the example of its application.

In what follows, the invention is described by reference to the accompanying illustrations, which show the pneumatic diagram of one oscillating device according to the invention.

Figure 1:
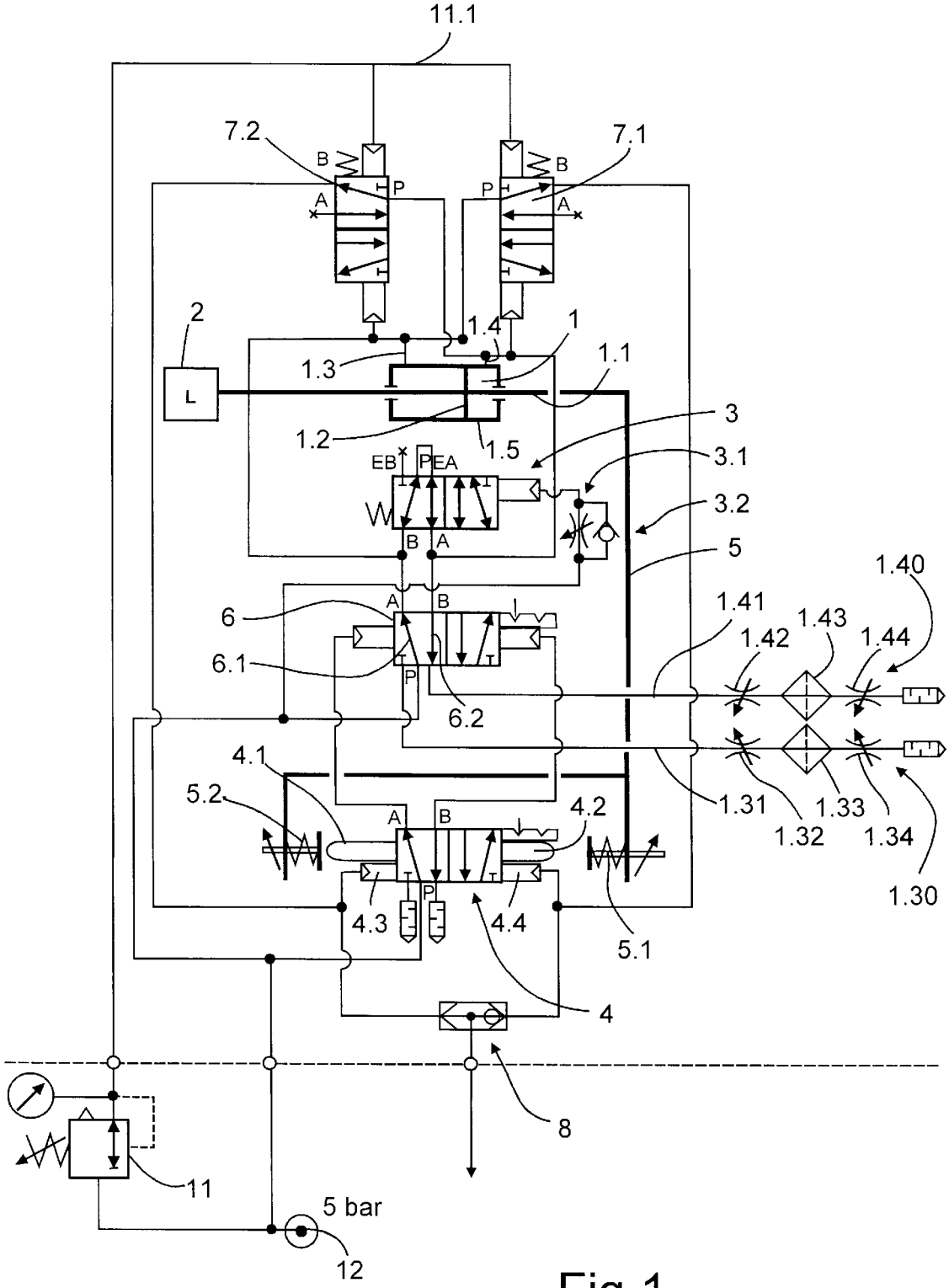
FIG. 1 shows the apparatus in the starting phase.

The principal components of a pneumatic oscillating device according to the invention are an operating cylinder 1, a principal control valve 6, and direction valve 4, as well as pressure limit switches 7.1 and 7.2. The valves used are mainly pressure-controlled direction valves. In addition, the device includes means for soft starting, which are formed with the aid of valve 3. The spring loading of limit switches 7.1 and 7.2 is also part of the soft starting, so that in the starting phase these are in the alarm position, but change their status immediately they receive full pressure to their controller inlet on the other side. They are controlled on the other side through the pressure reduction valve 11. On one side of the soft starting valve there is spring control and on the opposite side the full pressure is controlled through throttle 3.1, when slowed operation is achieved. The pressure coming through pressure line 12 is then led to both connections 1.3 and 1.4 of cylinder 1. After a delay, soft starting valve 3 changes its status, when normal operation can commence.

Figure 2:
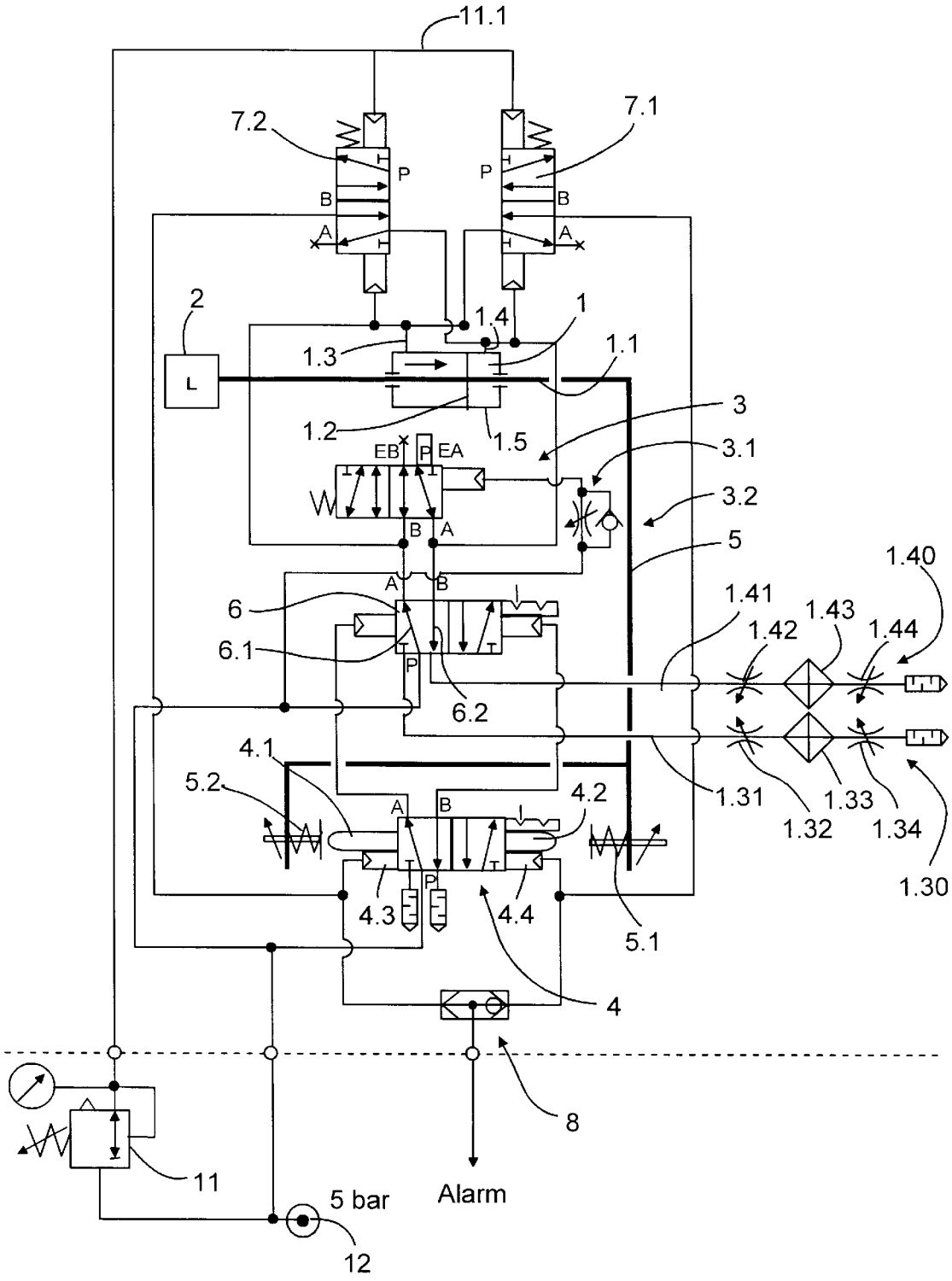
FIG. 2 shows the apparatus when operating.

FIG. 2 shows a normal operation situation of this kind, in which the piston is moving towards the right.

According to the invention, it is most advantageous to use a cylinder 1 equipped with a piston rod 1.1 on both sides, so that the piston can be set in bearings at both ends of the cylinder tube 1.5. One end of the piston rod 1.1 drives the load 2 and the free end is attached to operating lever 5 of reversing valve 4, which has adjustable stops 5.1 and 5.2 on both sides of the reversing valve, which operate the mechanical switches 4.1 and 4.2 of the reversing valve. There are also pneumatic auxiliary controllers 4.3 and 4.4 in the reversing valve, by means of which the change of direction can also be carried out, and which are connected to the pressure limit switches 7.1 and 7.1 to be described later. A mechanical reversing switch of this nature is reliable. In this situation, the reversing valve 4 directs the pressure from the pressure connection to outlet A, which has directed the principal control valve 6 to use the left-hand channel, when in this case the pressure connection is also directed to outlet A and in turn to the left-hand inlet 1.3 of the cylinder, which makes the piston move to the right. When the work stroke ends, the operating lever 5 presses the switch 4.1 of the reversing valve 4 through stop 5.2, when the reversing valve brings the right-hand channels into action. The pressure is then directed to outlet B, which in turn turns the principal control valve to the opposite position and the pressure is directed to its outlet B, and in turn to the right-hand connection 1.4 of the operating cylinder. This forces the piston 1.2 of the operating cylinder 1 to move to the left.

The reversing situation is controlled more precisely with the aid of outlet lines 1.31 and 1.41, either of which is connected to the corresponding outlet connection 1.3 or 1.4 by means of the principal operating valve 6. In the Figure, channel 6.2 of the principal operating valve 6 directs outlet connection 1.4 to outlet line 1.41, in which there is a primary, coarse throttle valve 1.42, a filter 1.43, and a secondary, fine throttle valve 1.44. The other outlet line 1.31 has corresponding components 1.32, 1.33, and 1.34. In normal operation, the fine throttle 1.44 determines the velocity at which the piston is able to move in the selected direction. During the reversing phase, full pressure comes initially to this return line, which would, without coarse throttle 1.42 be released directly into the great volume of filter 1.43. By means of coarse throttle 1.42, it is thus possible to adjust the reversing speed, and make a soft reverse. If there is no obstacle in load 2, piston 1.2 will continue its movement within the zone of movement set by stops 5.1 and 5.2. If an obstacle is encountered, i.e. when load 2 increases, the velocity of piston 1.2 decreases or even ceases completely. In this case, the effective pressure on the outlet side in this connection 1.4 is reduced at a speed determined by the fine throttle 1.44. As the pressure drops below the limit set by pressure reduction valve 11, the pressure limit switch 7.1 changes its direction, when the pressure is directed to outlet B, which in turn controls the auxiliary control connection 4.4 of the reversing valve. This causes a change in the direction of the operating cylinder as reversing switch 4 controls the principal operating valve 6. Movement in the other direction is controlled by the corresponding pressure limit switch 7.2, outlet B of which is in this case connected to the auxiliary control connection 4.3 of the reversing valve.

In the example, separate outlet lines 1.31, 1.41 with throttles have been used to the connections of the cylinder. These can naturally be connected at any point at all, when operation will become symmetrical in both directions.

In an oscillating device according to the invention, high-quality, long-life components are used. The control components of the oscillating device are slide-type reversing valves, in which there are no soft, wearing, moving gaskets. In the same way, the operating cylinder is equipped with a double-sided piston rod in the manner described above, so that its reliability is greater than that of a cylinder with a single piston rod. It is possible, by means of a solution according to the invention, to achieve a very great maintenance interval, of as much as twenty-five years. Gasket-less pneumatic valves are used in the oscillating device, so that there are no soft moving parts in them. Only the cylinder has rubber gaskets to seal the piston and the entry of the piston rod. Most advantageously all gaskets are either metal or ceramic. Contactless labyrinth seals can be used in the piston. Small leaks are of no consequence.

By means of an oscillating device according to the invention, it is possible to create gentle movement and soft starts and stops. An operating cylinder piston in accordance with the above does not jam at a randon obstacle, instead it continues moving to the extent that it is possible to do so, without damaging structures.

I claim:

1. A method in a pneumatic oscillating device for observing an obstacle within the length of the work stroke and continuing the oscillating movement thereafter, which oscillating device includes a double-acting operating cylinder (1), a principal operating valve (6) controlling the cylinder, and a reversing valve (4), by means of which the principal operating valve (6) is controlled, characterized in that:

a resistance to the flow on whichever return line (1.31, 1.41) of the operating cylinder (1) is in use, operates to maintain the return side pressure of the operating cylinder (1) at a level that is substantially higher than the ambient pressure during a work stroke in a normal situation;

sensing the pressure of the return side; and, if the sensed pressure drops below a set limit, which is indicated by the movement of the pressure slowing or stopping completely, giving a command to the reversing valve (4) to change direction on the basis of said drop in pressure.

2. An oscillating device, which includes an operating cylinder (1) equipped with connections (1.3, 1.4) on both sides, a principal operating valve (6) that operates the cylinder, and a reversing valve (4), by means of which the principal operating valve (6) is controlled, characterized in that:

the device includes a throttle valve (1.30, 1.40) for arranging a resistance on either return line; and pressure limit switches (7.1, 7.2) of the operating cylinder (1) applied to monitor both connections of the operating cylinder (1) during the work stroke and to command the reversing valve (4) to change direction, if the pressure drops below a set limit during the work stroke.

3. An oscillating device in accordance with Patent claim 2, characterized in that in the reversing valve (4) there are pneumatic reversing members (4.3, 4.4) in parallel with the mechanical reversing members (4.1, 4.2), to which the outlets of the pressure limit switches are connected.

4. An oscillating device in accordance with claim 2, characterized in that the piston rod (1.1) of the operating cylinder (1) is double-sided and the operating lever (5) of the mechanical reversing valve (4) is connected to the opposite side of the load connection (2).

5. An oscillating device in accordance with claim 2, characterized in that the pressure limit switches (7.1, 7.2) have a counter-pressure connection (11.1), and that the device includes a pressure setting member (11) for the counter-pressure connection in order to determine the trip pressure.

6. An oscillating device in accordance with claim 2, characterized in that the principal operating valve (6) also includes channels (6.2) for each of the outlet connections (1.3, 1.4) of the cylinder (1), which both have their own throttle valves (1.30, 1.40) for the independent adjustment of the corresponding directions of movement.

7. An oscillating device in accordance with claim 2, characterized in that in at least one outlet line (1.30, 1.40) there is a coarse throttle (1.31, 1.41), a filter (1.32, 1.42) with a gas capacity, and a fine filter (1.33, 1.43) in this order, in which case the coarse throttle (1.31, 1.41) is adapted to adjust the reversing speed and the speed of movement of the fine throttle (1.33, 1.43), when setting the direction of the relevant outlet line.

8. An oscillating device in accordance with claim 2, characterized in that the device includes soft-starting members, which include a special valve (3), which during starting directs full pressure to both sides of the piston (1.2) and slowly, with the aid of a throttle (3.1) is switched off to permit normal operation after a delay.

* * * * *

UNITED STATES PATENT AND TRADEMARK OFFICE

CERTIFICATE OF CORRECTION

PATENT NO. : 5,918,526

DATED : July 6, 1999

INVENTOR(S) : Lauri Jauhola

It is certified that error appears in the above-identified patent and that said Letters Patent is hereby corrected as shown below:

On the title page: Item ]22] the "PCT filed:" date should be --May 27, 1996 --.

Signed and Sealed this

Seventh Day of December, 1999

*Attest:*

*Attesting Officer*

Q. TODD DICKINSON

*Acting Commissioner of Patents and Trademarks*